United States Patent [19]

Stoll

[11] Patent Number: 4,527,589

[45] Date of Patent: Jul. 9, 1985

[54] VALVE ASSEMBLY

[76] Inventor: Kurt Stoll, Lenzhalde 72, 7300 Esslingen, Fed. Rep. of Germany

[21] Appl. No.: 486,614

[22] Filed: Apr. 20, 1983

[30] Foreign Application Priority Data

Apr. 28, 1982 [DE] Fed. Rep. of Germany ..... 3215782

[51] Int. Cl.[3] ..... F15B 13/043

[52] U.S. Cl. ..... 137/596; 137/596.16; 137/596.17; 137/625.64; 137/625.65; 137/884

[58] Field of Search ..... 137/596.17, 596.16, 137/884, 625.64, 625.65, 596

[56] References Cited

U.S. PATENT DOCUMENTS 3,698,432 10/1972 Kutz ..... 137/884
3,918,489 11/1975 Foster et al. ..... 137/884 X
4,095,864 6/1978 Hardin ..... 137/884 X

FOREIGN PATENT DOCUMENTS 2095795 10/1982 United Kingdom ..... 137/625.64

*Primary Examiner*—Edward G. Favors
*Attorney, Agent, or Firm*—Flynn, Thiel, Boutell & Tanis

[57] ABSTRACT

A valve assembly with a bank or row of switching valves has a base plate of u-like cross section with two flanges and a web therebetween. Within one of the flanges there is a common supply duct and in the other there is a common air outlet duct for the valves placed on the plate. The housings of the valves are generally block-like and their inlet and outlet ports are placed in opposite sides thereof. The sides with the air outlet ports furthermore have electrical connection pins for the solenoid magnets of the valves. A common electrical plug connector is placed covering over the pins of all the switching valves. There is a single muffler for all the switching valves.

10 Claims, 2 Drawing Figures

VALVE ASSEMBLY

FIELD OF THE INVENTION

The present invention relates to valve assemblies, and more specially to a valve assembly having a number of switching valves and a support or base plate, on which the switching valves are placed on a common assembly surface, or groups of switching valves are placed in their groups on a common assembly surface, the valve assembly having a supply duct with branch ducts opening through the assembly surface and connection ducts for driving loads, said connection ducts communicating with working ports of the switching valves.

BACKGROUND OF THE INVENTION

Such assemblies or banks of valves are used more specially for building up pneumatic program control systems and generally have an assembly plate with a common assembly surface for the switching valves that are joined up with a common air supply by way of a common compressed air feed line. There is a separate air let-off port for each switching valve and each such port has its own muffler.

SUMMARY OF THE INVENTION

One purpose of the present invention is that of designing a valve assembly of the sort noted that is simpler mechanically than known designs and takes up less space.

For effecting this purpose and further purposes there is a common air lef-off or waste air duct in the assembly plate for all the switching valves or for the groups of switching valves, which duct has branch ducts opening through the assembly surface and joining up with air let-off ports of the switching valves.

The valve assembly makes do without separate mufflers or waste air ducts for each of the separate switching valves, because there is a common air let-off duct in the assembly plate itself for all the switching valves or in each case for one group of switching valves. Because of the fact that the waste air branch ducts as well are designed opening through the common assembly surface, the connections needed in this respect are automatically produced on fixing each switching valve in position on the assembly plate. The putting together of a valve assembly is for this reason made very much simpler and there are less outside connections needing special space.

Further useful developments of the invention will be seen in the claims.

As one such further outgrowth of the invention the assembly plate has a u-like cross section and the supply duct and the air let-off duct are placed within the flanges of the cross-section, the branch ducts opening at the inner face of the flanges and the supply ports and the air let-off ports of the switching valves opening in opposite side faces of parallelpiped-like housing parts of the switching valves. Such a design is useful when it comes to miniaturizing the complete valve assembly, because the different connection ports of the switching valves may be placed in different limiting surfaces of the switching valves so that the valve housings may then be made specially small in size while at the same time it is possible to make certain that all the desired connections are automatically produced every time a switching valve is placed in position on the assembly plate.

It is furthermore possible for the control signal terminals of the switching valves to be supported on that side face of the valve housing that has the supply port or the air let-off port and for there to be a common control signal plug the control signal terminals being placed in line one to the back of the other. Such a design is of value in connection with producing a simple connection between the valve assembly and a control unit. It is then only necessary for one plug to be pushed home or for it to be pulled out for joining up the control unit or for unjoining it. A further rewarding effect of this development of the invention is that the unit formed by the valve assembly and the control signal plug has an even smoother outline or surface.

It is furthermore possible for the flange of the assembly plate with the air let-off duct within it to be broader than the flange having the supply duct, the control signal terminals being supported by the side face having the air let-off port of the switching valve. This makes it possible for the air let-off duct to have a large cross section and the space placed over the air let-off duct may then be used for the common control signal plug.

It is possible to have positioning pins, placed off center, on the switching valves, the pins being taken up in special holes therefor in the assembly plate. It is then possible for the different switching valves only to be placed facing in the right direction with respect to the assembly plate. These positioning pins may have elastic detent means so that the switching valves may be locked in position and taken off the assembly without the use of tools. This is a useful further development of the invention when it comes to replacing valves at a hard-to-get-at point on a program control system.

It is furthermore possible for the assembly to have cover bodies or dummy valves that have parts of the very same form as the form of the switching valves next to the assembly surface, but with blind holes in place of valve connection openings. This makes it possible to make do with one and the same sort of assembly plate for building up valve assemblies of different degrees of complexity. The spaces on the assembly plate that are not taken up by valves have the dummy valves placed on them.

The switching valves furthermore have a mechanical supporting function in connection with the common control signal plug terminal. To make it possible for this mechanical supporting or carrying function to be able to be used whatever the number of the switching valves on the assembly it is possible for at least the cover bodies or dummies placed at ends of the assembly plate to be mechanically the same in design with respect to the control signal terminals as the functioning switching valves, the control signal terminals of the dummies being inactive. With this further development of the invention the putting in position and taking off of a control signal terminal may be undertaken in quite the same way in every case so that there is very much less danger of a control signal terminal being put in the wrong position.

Further developments and useful effects of the invention may be seen from the detailed account now to be given using the figures herein

DETAILED DESCRIPTION

Figure 1:
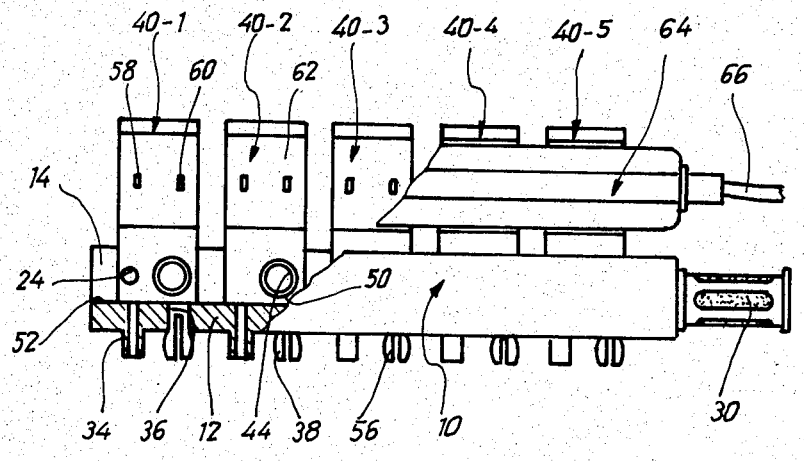
FIG. 1 is partly broken away side view of a valve assembly.

The valve assembly or bank to be seen in the figures has a supporting base or assembly plate 10 with a u-like cross section, that is to say with a web 12 or floor part and two side flanges 14 and 16. A compressed air supply duct 18 is formed in the flange 14 and one end thereof is shut off by a stopper 20, and in its other opposite end there is a connector 22 for the supply of compressed air into said duct. Branch ducts 24 come off the supply duct 18 at regular spacings therealong, such branch ducts opening in ports in the inner face of the flange 14.

Figure 2:
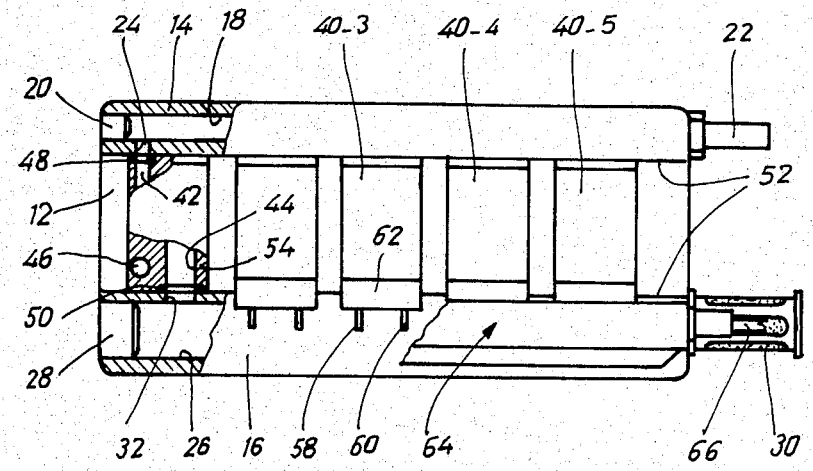
FIG. 2 is a partly broken away view of the same looking downwards.

The flange 16 is broader than the flange 14 and has an air let-off duct 26 formed in it which is shut off at the end to be seen on the left in FIG. 2 by a stopper 28, whereas the end on the right in FIG. 2 is joined up with the outside atmosphere through a muffler 30. There are furthermore branch ducts 32 running off from the air let-off duct 26 and opening at ports in the inner face of the flange 16.

The web 12 or floor of the assembly plate 10 has terminal connectors 34 (that is to say connectors with the function of terminals) for connection with pneumatic loads, the regular spacing of the connectors 34 being the same as that of the branch ducts 24 and 32. Keeping to this same spacing the web 12 furthermore has through holes 36 which take up positioning pins 38 of the valves. These pins are off-center in relation to the lower limiting face of the switching valves 40-1 to 40-5 under which the pins are placed.

In the present example the switching valves are 3/2 solenoid valves which each have an air inlet duct 42 running towards the flange 14, an air outlet duct 44 running towards the flange 16 and a working duct 46 running towards the web 12.

These ducts 42 to 46, which are used for connection of the valves, are air tightly joined up by o-rings 48 and 50 and by a further o-ring at the working duct 46 with a three-part assembly or mounting face 52 which is present in the form of the inner faces of the flanges 14 and 16 and the top side of the floor or web 12. In the unassembled condition these o-rings respectively project somewhat the opposite end faces (to the front and the back in FIG. 1) of a lower valve housing part 54 and beyond the lower side of the valve housing part 54 and are elastically squeezed when the valve housing part 54, fitting between the flanges 14 and 16 with a small amount of play, is pushed into position on the assembly or mounting of plate 10.

A switching valve 40 may only be fitted in position when the supply duct 42 is opposite to a branch duct 24 and the outlet air duct 44 is opposite to a branch duct 32, because it is only in this position that the valves's positioning pin 38 may be fitted into one of the through holes 36. As will be seen from FIG. 1, the positioning pins have a somewhat barrel-like form and have lengthways slots 56, that is to say they are bifurcated, so that the two sides of each pin 38 are bent inwardly towards each other elastically when they are pushed into the holes 36 and keep the valves in position because of the springing effect. In this way it is possible for the switching valves 40 to be plugged into the assembly plate 10 and to be taken off it again without needing any tools. Because the positioning pins 38, each acting as a locking pin, are placed right up next to one of the working ducts 46 and the terminal connectors 34, the forces produced when the working ducts are put under pressure, which have the tendency of forcing the switching valves 40 clear of the assembly plate 10, may taken up with a short lever arm effect. The forces produced by the effect of the pressure in the supply duct 42 on a switching valve 40 are taken up without any trouble over the surface of the flanges 16.

No details of the inside parts of the switching valves 40 are to be seen in the figures. In the top part of each such valve there is a driving electromagnet which is joined up with driving current by way of pins 58 and 60, such pins being placed on the same side of the switching valve as the air outlet duct 44. The pins 58 and 60 are supported by a top, overhanging housing part 62 running out past the outer face which is pressed up against the flange 16 of the valve housing part 54.

For producing an electrical connection between the valve assembly and an electrical controller (not shown), use is made of a rail or strip plug connector 64 running along all the pins 58 and 60 of the switching valves 40-1 to 40-5 and joined up with a cable 66 with the desired number of cores. As will be seen from the figures, the plug connector 64 has the effect of covering over the space over the broader flange 16 as a smooth cover in line with rest of the outline of the assembly, the pins 58 and 60 as well being covered over. The plug connector 64 is supported on all of the switching valves 40 equally.

In the event of one of the switching valves 40-1 to 41-5 not being needed, its place may be taken by a valve housing or dummy whose ducts 42 to 46 have their place taken by blind holes each having its own o-ring. It is in this way that the branch ducts coming from the supply duct, the air outlet duct and terminal connectors of the web 12 are shut off and put out of operation. Such a valve dummy, which is simply used as a stopper and has no electrical function, may have pins 58 and 60 in its top part, although it would be without any electrical function. In fact the function of such a dummy valve is that of making the assembly mechanically the same as one fitted only with working, functional valves. If the dummy needed does not have to be at the end of the assembly, the dummy may be simpler in design and only have a housing representative of the housing part 54, the ducts 42 to 46 being in the form of blind holes.

It will be seen that the valve assembly or bank detailed herein is highly modular in its design and has more or less smooth sides all the way round. It may furthermore be simply fixed in position and upkeep is simple. It is simple to make an electrical connection with an electrical controller and furthermore a single muffler may be used for all the switching valves.

It will furthermore be clear that pneumatically functioning valves may be used in place of the solenoid valves 40, in which case the plug 64 will be in the form of a pneumatic plug terminal and any dummies of stoppers will have the same mechanical design of their control signal ports as those of pneumatically controlled, fully functioning valves, the only difference being that there are blind holes in the place of ducts.

The embodiments of the invention in which an exclusive property or privilege is claimed are defined as follows:

1. A valve assembly, comprising a base plate and a plurality of switching valves seated on an assembly face on said base plate; said base plate having a supply duct formed therein and branch ducts which run off from said supply duct and communicate with said valves by way of first ports in said assembly face and by way of inlet transfer ports of said valves; said base plate having terminal ducts which communicate with working ports of said valves, said terminal ducts being designed for supplying loads; and said base plate further having a common air outlet duct for all said valves, said outlet duct having branch ducts which open through second ports in said assembly face and communicate with outlet transfer ports of said valves; wherein said valves are made with positioning pins which fit into holes provided in said base plate for making certain that said transfer ports of said valves are aligned with respective said ports of said base plate on putting such valves in place thereon.

2. The valve assembly as claimed in claim 1 wherein said pins have elastic detent means for springingly locking them in said holes in said base plate.

3. A valve assembly, comprising a base plate and a plurality of switching valves seated on an assembly face on said base plate; said base plate having a supply duct formed therein and branch ducts which run off from said supply duct and communicate with said valves by way of inlet ports in said assembly face and by way of inlet transfer ports of said valves; said base plate having terminal ducts which communicate with working ports of said valves, said terminal ducts being designed for supplying loads; said base plate further having a common air outlet duct for all said valves, said outlet duct having branch ducts which open through outlet ports in said assembly face and communicate with outlet air transfer ports of said valves; and including a dummy valve placed in line with said valves and stopping up at least one of said inlet and outlet ports in said base plate.

4. The valve assembly as claimed in claim 3 wherein said dummy valve has at least one blind hole aligned with at least one of said inlet and outlet ports in said base plate.

5. The valve assembly as claimed in claim 3, wherein said dummy valve is placed at an end of said base plate, said valves and said dummy valve each having signal terminals on a side thereof, said signal terminals of said dummy valve being dummy terminals.

6. The valve assembly as claimed in claim 1, including a muffler communicating with said outlet duct at an outlet end thereof.

7. The valve assembly as claimed in claim 1, wherein said base plate has a U-shaped cross section with first and second flanges joined together by a web, said supply duct and said outlet duct respectively being provided in said first and second flanges and said first ports and said second ports being respectively provided in inner surfaces of said first and second flanges, said valves each having a block-like part with said inlet and outlet transfer ports on opposite sides thereof.

8. The valve assembly as claimed in claim 7, including terminal connectors on said web which communicate with said terminal ducts and can be connected to loads which are to be controlled by said valves.

9. The valve assembly as claimed in claim 7, including control signal terminals on a side of each said valve which has one of said inlet and outlet transfer ports therein, and including a common control signal connector which can be releasably coupled to said control signal terminals on each said valve.

10. The valve assembly as claimed in claim 9, wherein said second flange, which has said outlet duct therein, is broader than said first flange, which has said supply duct therein, said control signal terminals being located on a side of each said valve which has the outlet transfer port therein.

* * * * *